United States Patent [19]

Blanchard

[11] Patent Number: 4,886,195

[45] Date of Patent: Dec. 12, 1989

[54] SIZE IDENTIFICATION SYSTEM FOR NESTING HANGERS

[75] Inventor: Russell O. Blanchard, Zeeland, Mich.

[73] Assignee: Batts, Inc., Zeeland, Mich.

[21] Appl. No.: 286,158

[22] Filed: Dec. 19, 1988

[51] Int. Cl.[4] ..... A47G 25/32

[52] U.S. Cl. ..... 223/85; 40/322

[58] Field of Search ..... 223/85, 88, 91, 92, 223/93, 95, 96; 40/322

[56] References Cited

U.S. PATENT DOCUMENTS 4,101,059 7/1978 Batts et al. ..... 223/85

4,115,940 9/1978 Phillips ..... 223/85 X 4,450,639 5/1984 Duester ..... 223/85 X

*Primary Examiner*—Werner H. Schroeder

*Assistant Examiner*—David K. Suto

*Attorney, Agent, or Firm*—Price, Heneveld, Cooper, DeWitt & Litton

[57] ABSTRACT

A molded plastic garment hanger has a portion of its hook, intermediate the top and bottom thereof, shaped to provide an information panel readable from one end of the hanger and shaped to permit the hangers to be nested together for shipment or storage without interference by the panels.

7 Claims, 2 Drawing Sheets

SIZE IDENTIFICATION SYSTEM FOR NESTING HANGERS

FIELD OF THE INVENTION

A molded plastic hanger in which the hook as an integral molded part of the hanger is provided with a panel for displaying information concerning the product on the hanger to anyone viewing the hanger lengthwise of the hanger utilizing a construction which also permits the hangers to be nested for either shipment or storage.

BACKGROUND OF THE INVENTION

A number of molded plastic hanger designs have been developed having means for attaching a display label or other device to the hanger's hook so that the article on the hanger can be identified by a person observing the hanger lengthwise as well as from the front. An example of such a hanger is U.S. Pat. No. 4,450,639 entitled HANGER WITH SIZE INDICATOR PANEL, issued to E. L. Duester, May 29, 1984. Hangers incorporating the concept of this patent are capable of being read from only one direction. Therefore, the hook must be correctly oriented on the supporting rod to make the information visible to the user. Further, this construction does not solve the problem of providing a hanger which both provides a visible display of the information from the end of the hanger and also permits the hangers to be nested together for either shipment or storage. This latter is important because, if the hangers do not nest, they become very bulky articles during shipment and, therefore, the cost of shipping is excessive. Also the cost of the packaging to ship them is excessive. In addition, in a number of user situations, hangers of this type are used with seasonal articles and, therefore, during the off season, must be stored. If the hangers do not nest, the result is an excessive demand upon storage space which, in many retailing facilities, is extremely limited at best. Accordingly, compact storage is important to the customer. Hangers of known construction have not combined the characteristics of a low cost, easily moldable product combined with compact storage and end or front information display. This invention solves all of these problems.

BRIEF DESCRIPTION OF THE INVENTION

This invention provides a molded, plastic hanger which can be molded utilizing relatively inexpensive, high production molds, which hangers can be nested tightly together for purposes of either shipment or storage. Further, the hanger provides a panel on which information concerning the articles suspended on the hanger can be read from the end of the hanger. The panel structure can be designed to be read with equal facility from either end of the hanger. This is important to eliminate the necessity of always aligning every hanger in the same direction, particularly in a retailing facility where customers, in many cases, handle the hangers and the garments thereon more frequently than the sales personnel. Further, the invention permits this objective to be obtained while locating the information display at a point high enough on the hook that the garments will not conceal the information. The invention provides a structure which does not adversely affect the strength of the hanger nor does it significantly increase the quantity of material used in molding the hanger. These are important considerations from a cost point of view.

DESCRIPTION OF THE PREFERRED EMBODIMENT

Figure 1:
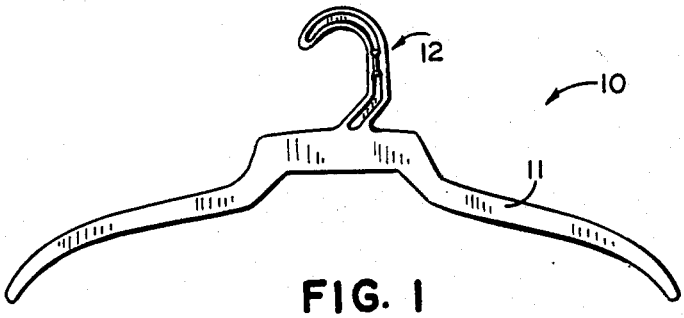
FIG. 1 is a front elevation view of a hanger equipped with this invention.

Referring to FIG. 1, the numeral 10 refers to a one-piece, molded plastic hanger having a body 11 supported by a central hook 12. The hook is preferably C-shaped in cross section to provide strength with minimum use of plastic. Thus, its back surface is hollow. The body of the hanger can be of the same cross-sectional construction or it can be of any of a number of other configurations such as can be seen in such U.S. Pat. Nos. as 249,619, issued Sept. 26, 1978 and 267,970, issued Feb. 15, 1983 and 273,072, issued Mar. 20, 1984.

Figure 3:
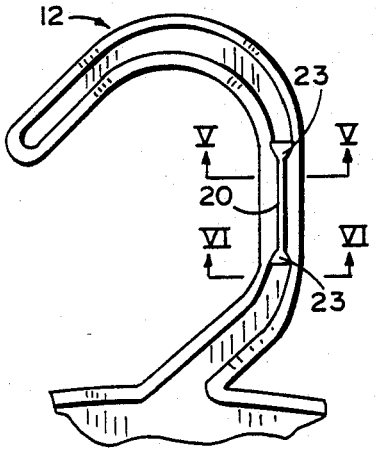
FIG. 3 is a fragmentary, front elevation view of the hook illustrated in FIGS. 1 and 2.
Figure 2:
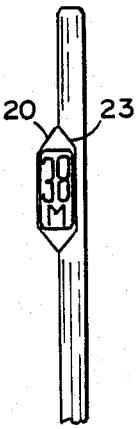
FIG. 2 is an enlarged, fragmentary, end elevation view of the hook portion of the hanger illustrated in FIG. 1.
Figure 4:
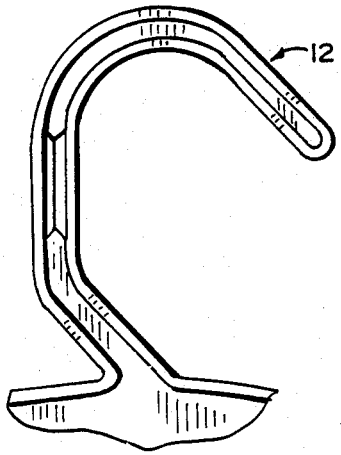
FIG. 4 is a fragmentary, rear elevation view of the hook illustrated in FIG. 3.
Figure 5:
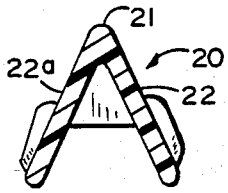
FIG. 5 is a sectional, elevation view taken along the plane V—V of FIG. 3.
Figure 6:
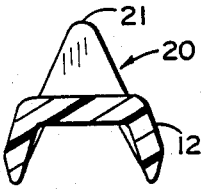
FIG. 6 is a sectional, elevation view taken along the plane VI—VI of FIG. 3.
Figure 7:
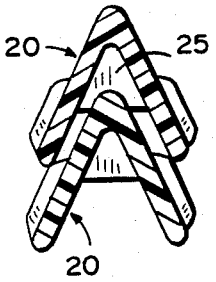
FIG. 7 is a sectional, elevation view taken along the same plane as FIG. 5, illustrating a pair of the hangers in nested relationship.
Figure 11:
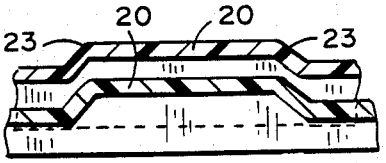
FIG. 11 is a fragmentary, sectional, elevation view taken along the plane XI—XI of FIG. 10.

To provide an information display panel on the hook, the hook is provided with a straight vertical portion or section 20. The section 20 is V-shaped in cross section with the apex 21 of the section projecting forwardly. In the preferred construction, the sides of the display section are identical and provide a first inclined display panel 22 facing toward one end of the hanger and an identical, second display panel **22*a* facing toward the other end of the hanger. Like the rest of the hook, the section 20 is hollow creating an internal pocket 25 (FIG. 7). Also, the ends 23 of the section are inclined away from the apex of the section (FIGS. 2, 3 and 11). This results in hangers the sections 20 of which will nest, one within the other, when the hangers are seated one against the other. At the same time, the sides of the section 20 provide panels 22 and 22***a* each having an area for information display which are comparable in size to that of the panel construction disclosed in U.S. Pat. No. 4,450,639 noted above. The desired information can be provided by labels adhesively secured to one or both panels. The reshaping of the cross section of the hook in the section 20 area does not adversely affect the strength of the hook or its ability to resist torsional deflection. It does not complicate the molding of the hanger or materially increase the quantity of plastic required.

Figure 8:
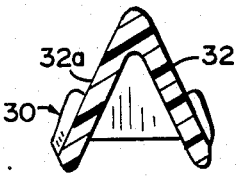
FIG. 8 is a sectional view similar to FIG. 5 illustrating a modified construction for the hanger.
Figure 9:
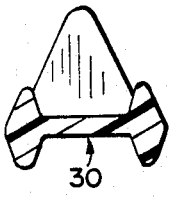
FIG. 9 is a sectional elevation view of the modified hanger of FIG. 8 taken along the same plane as FIG. 6.
Figure 10:
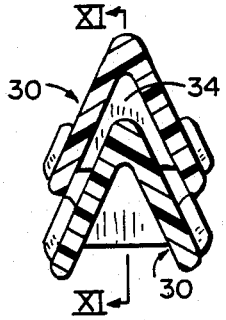
FIG. 10 is a sectional, elevation view similar to FIG. 7 but illustrating the hanger of FIGS. 8 and 9 in nested condition.

The invention can be applied to a hook 30 of I-beam cross section as illustrated in FIGS. 8–10. In this construction, a V-shaped cross section for the panel area 31 is again utilized, permitting the panels 32 and 32*a* to provide an internal pocket 34 to receive the panel area of a like hanger (FIG. 10). Thus, the hangers can be compactly stacked, one against another, in as compact a configuration as such hangers could have been stacked without the display panels.

Figure 12:
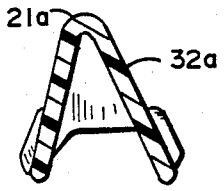
FIG. 12 is a sectional view similar to FIG. 5, illustrating a modified version of the invention.
Figure 14:
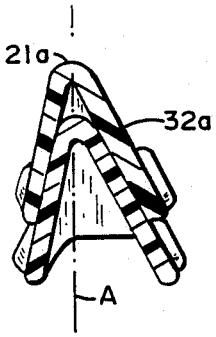
FIG. 14 is a sectional view similar to FIG. 7 illustrating a pair of the hangers of FIG. 12 in nested relationship.

It will be understood that the sections 20 or 30 need not be symmetrical in cross section. One of the panels 32*a* can be larger than the other which will reposition the apex 21*a* eccentrically of the centerline A of the section (FIGS. 12 and 14). The amount of eccentricity is limited only by the necessity that the sections must be able to nest without requiring one hanger to be laterally offset with respect to the other. By so shifting the apex of the section toward one edge of the hook, such as the edge facing the hook opening, the width of the panel 32*a* useable for information display can be increased.

Figure 13:
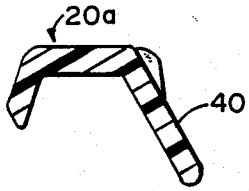
FIG. 13 is a sectional view illustrating a further modification of the invention.
Figure 15:
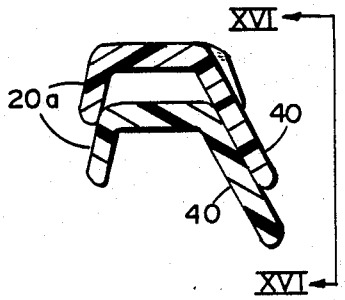
FIG. 15 is a sectional view similar to FIG. 7 illustrating a pair of hangers of FIG. 13 in nested relationship.
Figure 16:
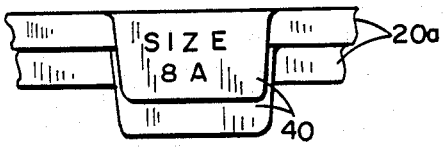
FIG. 16 is a fragmentary sectional view taken along the plane XVI—XVI of FIG. 15.

A further modification is illustrated in FIGS. 13, 15 and 16 wherein the information display panel 40 is formed by a rearward extension of the side of the straight section 20*a* which faces away from the open side of the hook 12. This arrangement can be utilized when a larger, more visible panel is required. It does prevent the bottom hanger from seating flat on a supporting hanger but this can be overcome by placing a support pad under the hook which is of a thickness comparable to the distance the panel 40 projects from the rear face of the hanger. The nesting and compact packaging of the rest of the hangers nested together, however, will be exactly the same as with the hangers of FIGS. 2–11.

The invention provides a one-piece hanger which can be molded in simple two-piece molds having no moveable sections since there are no undercuts, openings or recesses which are not fully accessible when the molds are moved between open and closed positions. The hangers can be molded from any suitable synthetic resin, such as polypropylene or polystyrene.

Having described the invention and modifications thereof it will be recognized that additional modifications can be made without departing from the principles of the invention. Such modifications are to be considered as included in the hereinafter appended claims, unless these claims by their language expressly state otherwise.

I claim:

1. A garment hanger having a body and a molded plastic support hook, said support hook having forward and rear faces and a straight vertical portion spaced from both the body of the hanger and the top of the hook, said portion being offset forwardly to form a pair of vertically elongated panels having flat faces, said panels being integral with each other along one of their edges and at their juncture forming an apex, said portion being hollow and forming a pocket opening through the rear face of said hook into which the apex of a similar offset portion can be seated when a pair of said hangers are nested together with the front face of one in abutment with the rear face of the other of said pair and the rearwardly extending portions of said hook and body aligned with each other.

2. The garment hanger described in claim 1 wherein said apex is centered between the edges of said hook and at least one of said panels extends to the rear edge of said portion.

3. The garment hanger described in claim 2 wherein both of said panels extend to the rear edge of said hook.

4. The garment hanger described in claim 2 wherein only the panel facing away from the opening in said hook extends to the rear face of said hook.

5. The garment hanger described in claim 1 wherein said apex is offset from the centerline of said portion toward the opening in said hook and the panel facing away from the opening in said hook is larger than the panel facing toward the opening in said hook.

6. A molded plastic garment hanger having an elongated body and a molded support hook, said support hook having spaced forward and rear faces and a straight vertical portion spaced from both the body of the hanger and the top of the hook, said portion having a rearwardly extending leg along the edge thereof facing away from the opening in said hook, said leg being inclined outward from a plane normal to the front face of said hook and extending rearwardly beyond the rear face of said portion to provide a panel visible from the adjacent end of said hanger whereby a pair of hangers each having a similar panel can be nested together with the front face of one in abutment with the rear face of the other.

7. A garment hanger having a body and a molded plastic support hook, said support hook having forward and rear faces and a straight vertical portion spaced from both the body of the hanger and the top of the hook, said portion in cross section having a pair of forwardly and rearwardly extending flanges connected by a web, the one of said flanges remote from the opening in the hook being inclined to a plane normal to the lengthwise axis of the hanger body and extending rearwardly of the rear face of the hanger to provide an information display panel, the inclination of said panel being such that a pair of said hangers can be nested together with the panels thereof overlapping and the front face of one hanger in contact with the rear face of the other and the bodies of the hangers aligned.

* * * * *

UNITED STATES PATENT AND TRADEMARK OFFICE

CERTIFICATE OF CORRECTION

PATENT NO. : 4,886,195

DATED : December 12, 1989

INVENTOR(S) : Russell O. Blanchard

It is certified that error appears in the above-identified patent and that said Letters Patent is hereby corrected as shown below:

Column 2, line 53:

After "and" insert -- Des. --

Column 2, line 54:

After "and" insert -- Des. --

Signed and Sealed this

Twenty-first Day of May, 1991

*Attest:*

HARRY F. MANBECK, JR.

*Attesting Officer*

*Commissioner of Patents and Trademarks*